US010801195B2

(12) United States Patent
Morse

(10) Patent No.: US 10,801,195 B2
(45) Date of Patent: Oct. 13, 2020

(54) SANITARY PLUNGER

(71) Applicant: Thomas C. Morse, Greensboro, NC (US)

(72) Inventor: Thomas C. Morse, Greensboro, NC (US)

( * ) Notice: Subject to any disclaimer, the term of this patent is extended or adjusted under 35 U.S.C. 154(b) by 0 days.

(21) Appl. No.: 16/408,112

(22) Filed: May 9, 2019

(65) Prior Publication Data

US 2019/0345704 A1 Nov. 14, 2019

Related U.S. Application Data

(60) Provisional application No. 62/669,753, filed on May 10, 2018.

(51) Int. Cl.

| | |
|---|---|
| ***E03C 1/308*** | (2006.01) |
| ***E03F 9/00*** | (2006.01) |
| ***A47K 11/10*** | (2006.01) |

(52) U.S. Cl.

CPC ..... *E03C 1/308* (2013.01); *A47K 11/10* (2013.01); *E03F 9/002* (2013.01)

(58) Field of Classification Search

CPC ..... E03C 1/308; A47K 11/10; A47K 11/105
See application file for complete search history.

(56) References Cited

U.S. PATENT DOCUMENTS

| | | | | |
|---|---|---|---|---|
| 6,701,540 | B1 * | 3/2004 | Gabriel | E03C 1/308 4/255.11 |
| 7,124,450 | B2 * | 10/2006 | Davidson | E03D 9/00 4/255.11 |
| 7,281,278 | B1 | 10/2007 | Biagi et al. | |
| 7,299,519 | B1 * | 11/2007 | Garry | A46B 7/023 15/104.05 |
| 7,328,793 | B2 * | 2/2008 | Leaphart, Jr. | A47K 17/00 206/15.2 |
| 7,523,510 | B1 * | 4/2009 | Biagi | E03C 1/308 221/63 |
| 8,020,222 | B2 | 9/2011 | Falcon et al. | |
| 8,020,223 | B2 * | 9/2011 | Falcon | A47K 17/00 4/255.01 |
| 8,307,468 | B2 * | 11/2012 | Stein | E03C 1/308 4/255.11 |
| 8,510,874 | B2 | 8/2013 | Duboc | |
| 2010/0000010 | A1 | 1/2010 | Martinisko | |
| 2012/0318688 | A1 | 12/2012 | Martinisko | |
| 2015/0060313 | A1 | 3/2015 | Martinisko | |

* cited by examiner

*Primary Examiner* — Janie M Loeppke
(74) *Attorney, Agent, or Firm* — Patterson + Sheridan, LLP

(57) ABSTRACT

The system disclosed herein is directed to a plunger having a protective sleeve for shielding contaminants from the plunger. The plunger includes a handle, and a flexible cup. The body further includes a tab, a shoulder region, a central portion, a first tail, and a second tail. An inlet is disposed on the external surface of the flexible cup. The inlet is coupled to a connector. A through-hole is disposed in the flexible cup or the handle. The through-hole is configured to receive the body of the protective sleeve by passing a portion of the body through an opening of the flexible cup.

20 Claims, 15 Drawing Sheets

SANITARY PLUNGER

CROSS-REFERENCE TO RELATED APPLICATIONS

This application claims benefit of U.S. provisional patent application Ser. No. 62/699,753, filed May 10, 2018, entitled "Sanitary Plunger", which is herein incorporated by reference.

BACKGROUND OF THE INVENTION

Field of the Invention

The system disclosed herein is directed to a method and apparatus for sanitarily unclogging a toilet.

Description of the Related Art

When a toilet in a bathroom facility becomes clogged due to waste or other debris, depending on the severity of the clog, the toilet may require plunging by an occupant or owner of the bathroom facility. The toilet plunger was invented in the late 1800's and has remained essentially unchanged over the past 150 years. While major technological advances have been made in medicine, aerospace, computing, transportation, and many other facets to improve the health and quality of life, little to no progress has been made to effectively eliminate or minimize the transfer of germs and bacteria associated with cleaning, sanitizing and handling of a dirty plunger after use. In addition, many consumers express embarrassment in storing a plunger next to the toilet and consider it to be unsightly. As such, a user may store the dirty plunger in a remote location. However, such relocation may result in additional inconvenience or potentially further embarrassment if a guest clogs the toilet and cannot easily locate the plunger.

Users commonly clean conventional plungers by rinsing with the flush water of the toilet. Users may also attempt to clean the plungers by rinsing in the bathtub, or by rinsing off with hot water. However, effectively cleaning a plunger comes with the challenge of ensuring that all contaminants and debris are effectively removed from both the interior and exterior of the plunger. Contaminants, including fecal matter and toilet paper, may include dangerous bacteria since there's no assurance that they are killed or removed during the rinsing process. Additionally, bacteria and contaminants are microscopic and not visible with the naked eye, thus it's impossible to conduct a visual inspection and determine if the plunger has been adequately cleaned to eliminate all disease-causing organisms, germs and bacteria.

Because many plungers have contours and shapes that have a tendency to hold and contain debris, the shape of the plunger reduces the effectiveness of rinsing in the toilet bowl. It is also difficult to determine if debris inside of the plunger has been effectively cleaned without tipping the plunger upright to look inside, which results in water and/or contaminants dripping onto the user's hands. While some consumers rinse their dirty plungers in "clean" toiler water, others attempt to clean them in their bathtub, shower, kitchen or laundry sink, or outside with a garden hose. This requires that the dirty, wet, dripping plunger be moved from the toilet after use, to one of these alternate locations for cleaning, which typically contaminates other surfaces, such as the toilet rim, bathroom floor, carpeting, counter surfaces, etc. during transport.

After cleaning the plunger, users often store the plunger for future use. Users often hide the plunger, commonly in a location outside of the bathroom, further inconveniencing the user when it's needed. Users have a variety of solutions, of which the most common include: storing the plunger in a remote location such as in a closet, underneath a vanity, or in a garage, because they consider it to be unsightly and embarrassing. This feeling of unsightliness and embarrassment is typically rooted in the fact that a user may be unsure how to effectively clean and disinfect the plunger or have difficulty cleaning the plunger. While there are plungers and devices on the market for unclogging toilets and drains that claim to be clean, these devices require additional disinfecting prior to or after use.

Thus, there is a need for an improved apparatus and method that can reduce contamination and sanitarily unplug a toilet.

SUMMARY OF THE INVENTION

Disclosed herein, are methods and apparatuses for enclosing contaminants that includes a plunger and a protective sleeve. The apparatus and system disclosed herein substantially eliminates the mess and contamination of surrounding areas from dripping after toilet plunging. The disclosed system and apparatus further enables ease of cleaning and storage of the plunger, in manner that eliminates the embarrassing aspects of conventional manner of cleaning and storing the plunger.

The system disclosed herein is directed to a plunger having a protective sleeve for shielding contaminants from the plunger. The plunger includes a handle having a first end and a second end. The plunger also includes a flexible cup that has an interior surface and an exterior surface. The protective sleeve includes a body made from a flexible non-permeable material. The body of the protective sleeve has an internal wall and an external wall. The body further includes a tab, a shoulder region, a central portion, a first tail, and a second tail. An inlet is disposed on the external surface of the flexible cup. The inlet is coupled to a connector. The connector is coupled to the handle. A through-hole is disposed in the flexible cup or the handle. The through-hole is configured to receive the body of the protective sleeve by passing the tab through an opening of the flexible cup.

In another example, a system for enclosing contaminants is described herein that includes a plunger and a protective sleeve. The plunger includes a handle that has a first end and a second end. A flexible cup has an interior surface and an exterior surface. A through-hole in the handle or the flexible cup. The protective sleeve includes a body made from a flexible non-permeable material. The body has an internal wall and an external wall. The body also includes a tab, a shoulder region, a central portion, a first tail, and a second tail. An inlet is disposed on the external surface of the flexible cup. The inlet is coupled to a connector. The connector is coupled to the handle. A through-hole is disposed in the handle or the flexible cup. The through-hole is configured to receive the body of the protective sleeve by passing the tab through the opening of the flexible cup. The first tail and second tail of the protective sleeve are configured to be pulled over the exterior surface of the force cup. The first tail and second tail are used to secure the upper portion of the protective sleeve to the handle or the flexible cup.

Disclosed herein is a method of enclosing contaminants utilizing a first protective sleeve with a plunger. The method includes passing the first protective sleeve through an opening in a lower portion of an internal surface of a flexible cup of the plunger. The flexible cup is coupled to a handle. The first protective sleeve has a leading portion and a trailing portion. The leading portion of the first protective sleeve is passed through a through-hole in the flexible cup, or an opening in the handle. The trailing portion of the protective sleeve is pulled over an external of the flexible cup. A portion of the first protective sleeve is secured to the external surface of the flexible cup or to the handle.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the attached drawings. It is to be noted, however, that the drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements and features of one example may be beneficially incorporated in other examples without further recitation.

DETAILED DESCRIPTION

Disclosed herein is a method and apparatus for enclosing contaminants that includes a sanitary plunger having a protective sleeve. The methods and apparatus of encapsulating and isolating contaminants while unclogging a toilet, substantially eliminates the common problems associated with conventional plungers.

Advantageously, the sanitary plunger disclosed herein utilizes a unique bagging process having a protective sleeve to isolate the plunger head (i.e., cup) and handle from fecal matter, debris, or bacteria that accumulates in dirty toilet water. The apparatuses and methods disclosed also substantially prevent the plunger from becoming wet or contaminated during the plunging and handling process. After plunging, the protective sleeve is advanced around the exterior of the plunger head, through the inside of the plunger head, and through the handle of the plunger in such a way that the wet, dirty internal side of the protective sleeve is enclosed, effectively encapsulating the bacteria-laden water, debris and contaminants on the inside of the protective sleeve. The protective sleeve is then sealed and removed for disposal. The plunger can simply be stored anywhere for future use, as it does not require cleaning, sanitizing, or drying.

Figure 1:
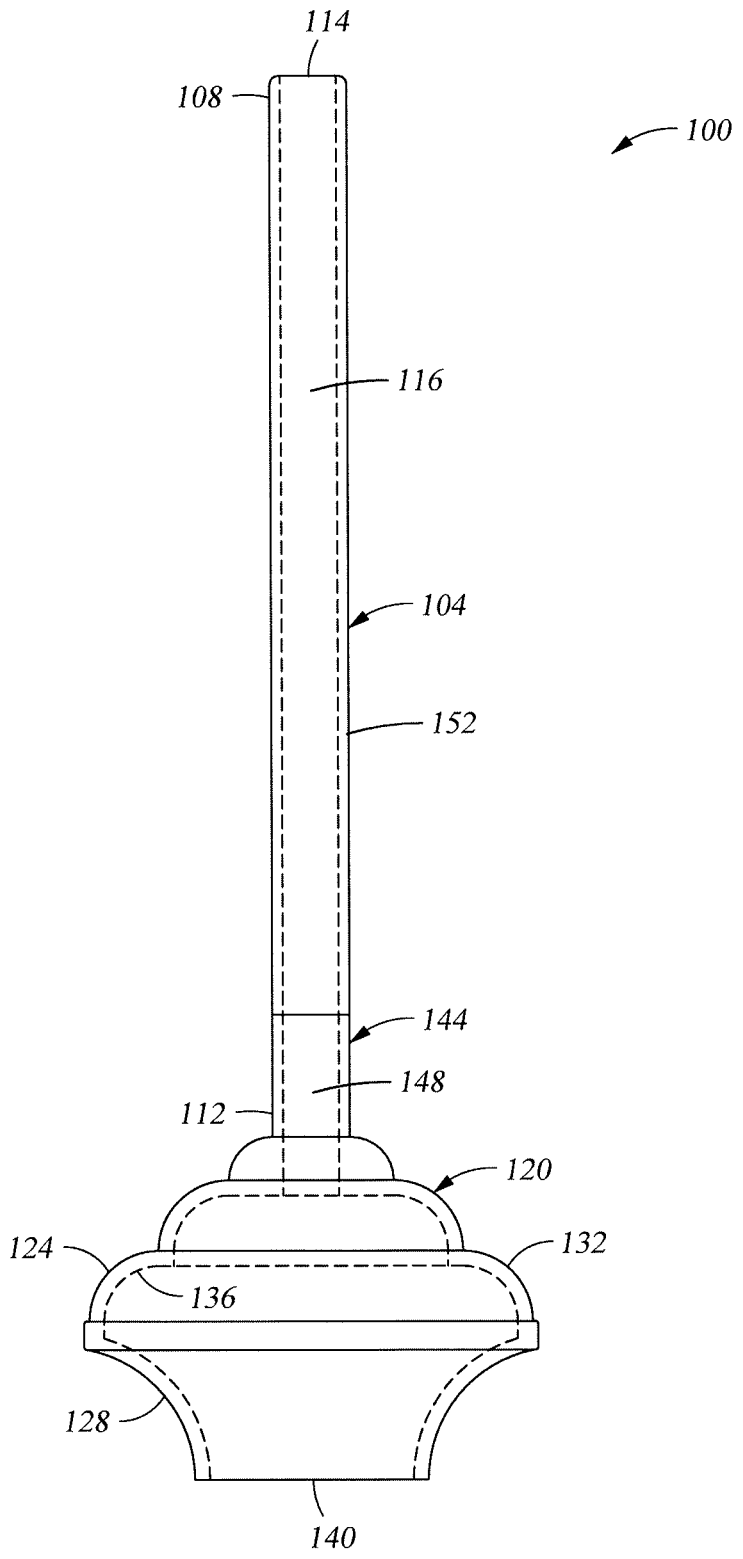
FIG. 1 is a schematic side plan view of a sanitary plunger having a handle and a flexible cup.

FIG. 1 is a schematic plan view of a part of an exemplary sanitary plunger 100 having a handle 104 and a flexible cup (i.e., a plunger head) 120. The handle 104 includes a top portion 108 and a bottom portion 112. The handle 104 may be substantially cylindrical, having an oblong, circular, rectangular or other profile, but is not limited to that shape. The handle 104 may be hollow, partially hollow, or solid. When the handle 104 is hollow, a hollow cavity 116 is interior of the handle 104 and extends from the top portion 108 to the bottom portion 112 of the handle 104. When the handle 104 is partially hollow, the hollow cavity 116 may extend only partially from the bottom portion 112 toward the top portion 108 in the interior of the handle 104. The handle 104 has an external surface 152 outside and opposite the hollow cavity 116 in the interior.

The hollow cavity 116 has a length that is sufficient to accommodate a connector 144. The connector 144 couples the handle 104 to the flexible cup 120. The connector 144 may also have a hollow section 148. The hollow section 148 is coupled to the hollow cavity 116. Alternately, the connector 144 may be a solid structure. In some examples, the connector 144 is partially solid and partially hollow. In one example, the handle 104 and connector 144 may be attached and detached. In yet another example, the handle 104 is integrated with the connector 144 such that the handle 104 and connector 144 are a single structure. In a case where the handle 104 is solid, the handle 104 may be integrated with the connecter 144 as a single piece.

The flexible cup 120 may include an upper base 124 and a lower base 128. The connector 144 couples the handle 104 to the upper base 124 of the flexible cup 120. The flexible cup 120 has an exterior surface 132 and an interior surface 136. The exterior surface 132 and interior surface 136 converge at an opening 140 of the flexible cup 120. The opening 140 is positioned in the lower base 128 of the flexible cup 120.

Figure 2:
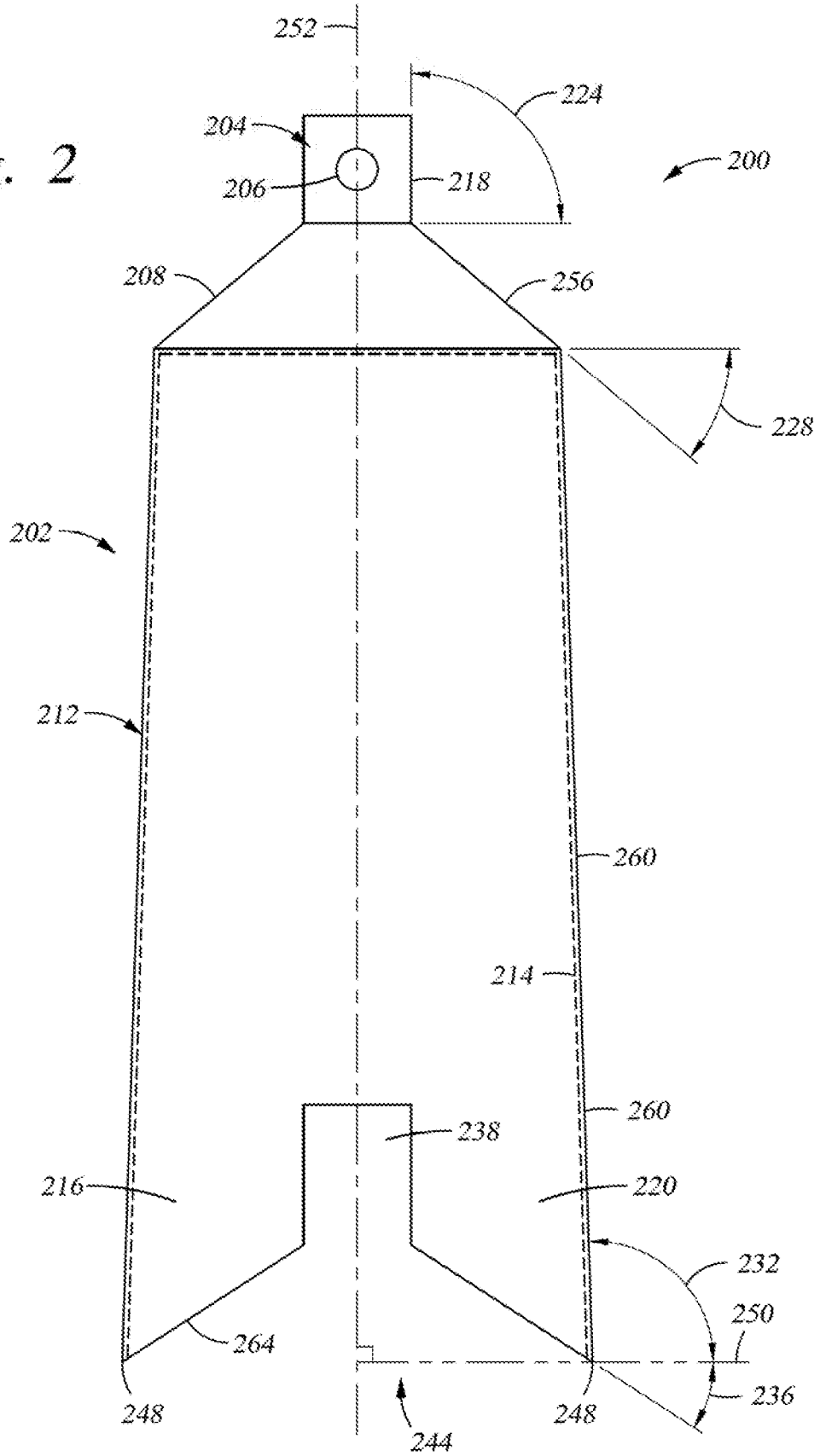
FIG. 2 is a schematic side plan view of a protective sleeve configured to cover the flexible cup of FIG. 1.

FIG. 2 is a schematic side plan view of a protective sleeve 200 configured to cover the flexible cup 120 of FIG. 1. The protective sleeve 200 may be a thin polymer film formed in the shape of a tube, sleeve, or bag. When the protective sleeve 200 is opened, it a diameter larger than a diameter of the flexible cup 120. The protective sleeve 200 may have a tab 204, a shoulder 208, and a body 212. The body 212 may have a first tail 216 and a second tail 220. Each of the first tail 216 and second tail 220 may have a tip 248. The first tail 216 and second tail 220 may be in the shape of a trapezoid, oval or any other geometric shape which allows the opening 244 of the protective sleeve 200 to be secured by tying together the tips 248 of the first tail 216 and the second tail 220. In this example of the protective sleeve 200 is substantially bisected by a center line 252. Accordingly, as illustrated in FIG. 2, each of the tab 204, shoulder 208, body 212, and first and second tails 216 and 220 are substantially symmetric about the center line 252. However, the tab 204, shoulder 208, body 212, and the first and second tails 216 and 220 may be asymmetric about the center line 252 without departing from the disclosure herein. An imaginary line 250 is substantially perpendicular to the center line 252. The protective sleeve 200 may be made of a material non-permeable to water and other waste suitable for disposal into a public sanitary sewer system or septic system, such as plastic or coated paper, preferably bio-degradable.

The tab 204 of the protective sleeve 200 includes an aperture 206. The aperture 206 may be a hole, slot, of any geometric shape sufficient to be threaded, hooked, or caught by a second protective sleeve substantially to protective sleeve 200 or a hooking apparatus (not shown). A first angle 224 is formed between a first external wall 218 of the tab 204 and the imaginary line 250. In some examples, the first angle 224 may be about 90 degrees with respect to the imaginary line 250. It should be appreciated that other angles, such as about 91 degrees to about 120 degrees, or even other angles are equally suitable for first angle 224. The angles discussed herein are described based upon their relationship to the imaginary line 250 by extending the wall, line or angle to the imaginary line 250.

The shoulder 208 of the protective sleeve 200 couples the tab 204 to the body 212. A second angle 228 is formed between a second external wall 256 of the shoulder 208 and the imaginary line 250. In some examples, the second angle 228 may form an acute angle that is less than 90 degrees.

The body 212 of the protective sleeve 200 includes an internal wall 214 and a third external wall 260. A third angle 232 is formed between the third external wall 260 and the imaginary line 250. In some examples, the third angle 232 may be a second obtuse angle greater than 90 degrees. In the example illustrated, the third angle 232 is greater than the second angle 228. However, the protective sleeve 200 is not limited to that configuration.

An opening 244 in the body 212 of the protective sleeve 200 enables access to the internal wall 214. A recess 238 is positioned in the opening 244. The recess 238 is also positioned between the first tail 216 and second tail 220. A fourth angle 236 is formed between the imaginary line 250 and a fourth external wall 264 of the first tail 216. The fourth angle 236 is mirrored across the opening 244 and additionally formed between the imaginary line 250 and the fourth external wall 264 of the second tail 220. In this example, the fourth angle 236 forms an acute angle with the imaginary line 250.

Figure 3:
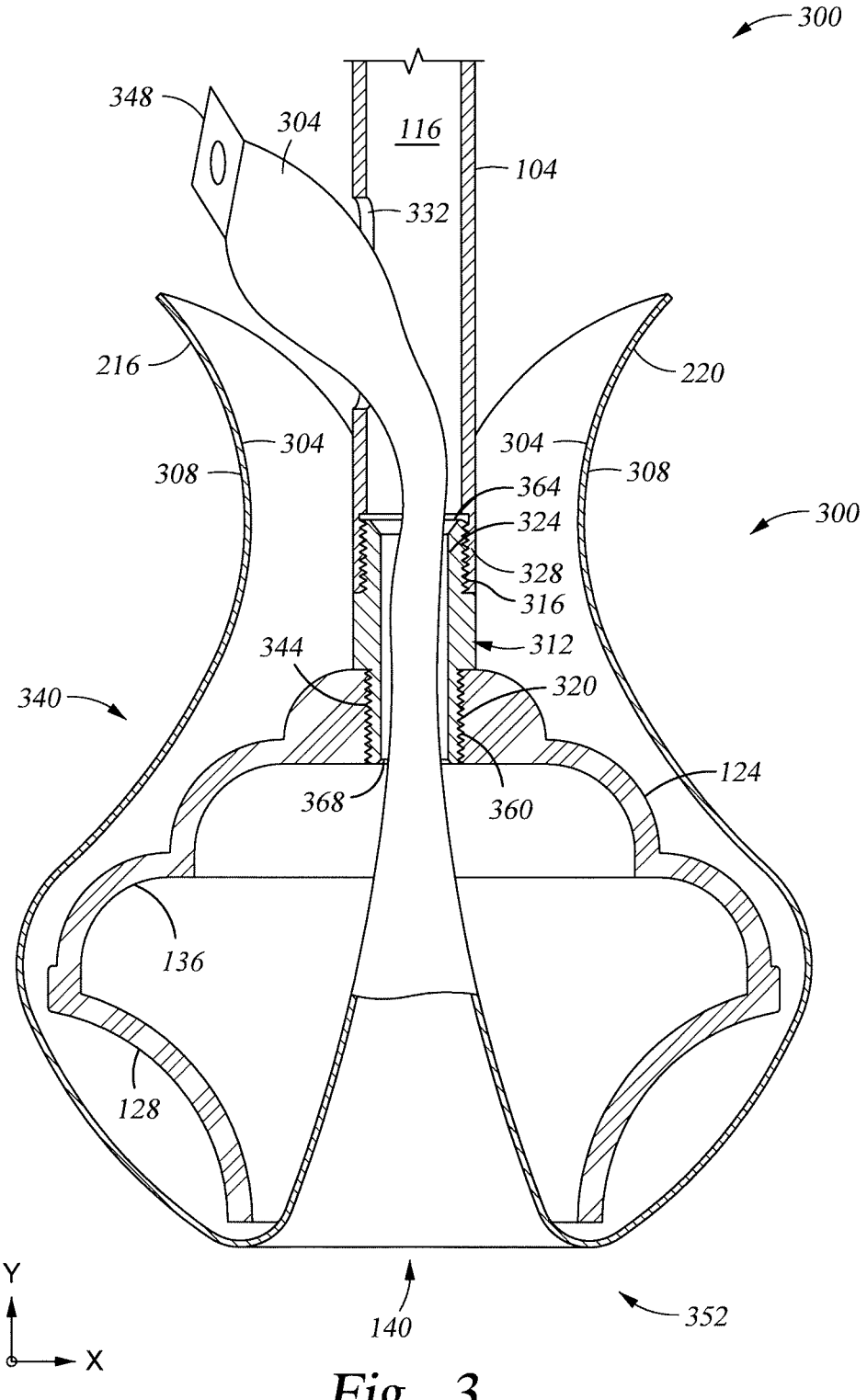
FIG. 3 is a side plan view of the sanitary plunger having a protective sleeve encasing a flexible cup according to one embodiment.

FIG. 3 is a side plan view of the sanitary plunger 300 having a protective sleeve 200 encasing a flexible cup 340 according to one embodiment. A sanitary plunger 300 additionally has a connector 312. The handle 104 has a through-hole 332 provided in the handle 104, which passes through an external side of the handle 104 into the hollow cavity 116. The through-hole 332 substantially intersects the hollow cavity 116 of the handle 104 at about 90 degrees. However, the angle at which the through-hole 332 intersects the hollow cavity 116 is not limited, and can be any angle so long as the through-hole 332 permits the protective sleeve 200 to pass therethrough.

The handle 104 has a threaded portion 364 that is configured to receive a connector 312. An eyelet 328 may pass through the external side of the handle 104 to the hollow cavity 116. A cross-sectional area of the through-hole 332 is greater than the cross-sectional area of the eyelet 328. The eyelet 328 is configured to receive a protrusion 324 of the connector 312. The connector 312 may be secured by an adhesive material, or by a biasing or compressive force (described below). As stated above, the connector 312 is not limited to this configuration. The connector 312 may be integral with the handle 104, e.g., formed from injection molding.

The connector 312 is configured to couple the handle 104 to the flexible cup 340. The connector 312 may have the hollow section 148, but may also be solid. The connector 312 may have a first threaded portion 316 having a first diameter 356. At least a portion of the first threaded portion 316 is configured to be attached, i.e., thread into, the threaded portion 364 of the handle 104. The protrusion 324 may be positioned in the first threaded portion 316. The protrusion 324 is configured to pass through the eyelet 328 of the handle 104, thus substantially preventing rotation of the connector 312. In this manner, the connector 312 is securely coupled to the handle 104. In this manner, the handle 104 is coupled to the connector 312.

The connector 312 also has a second threaded portion 320. The second threaded portion 320 has a second diameter 360. Threads of the second threaded portion 320 may be smaller, i.e., closer in proximity to one another, than threads of the first threaded portion 316. The second threaded portion 320 is configured to be received by an inlet 344. The inlet 344 is disposed in the upper base 124 of the flexible cup 340. The second threaded portion 320 is configured to secure the connector 312 to the flexible cup 340. In some examples, the inlet 344 may be threaded.

As in the other examples, the opening 140 of the flexible cup 340 is positioned in the lower base 128. In some examples, the flexible cup 340 may only have the upper base 124. In that configuration, the flexible cup 120 is substantially bell-shaped. However, it should be appreciated that the shape of the flexible cup 120 is not limiting to the disclosure provided herein.

The inlet 344 is positioned within the upper base 124. The inlet 344 of the flexible cup 340 includes an orifice 368. The orifice 368 is configured to enable the protective sleeve 200 to pass from the opening 140 of the flexible cup 340 and through the hollow section 148 of the connector 312. The diameter of the orifice 368 is large enough to substantially prevent water, debris, and other contaminants captured by the protective sleeve 200 from being forced out of the enclosed protective sleeve 200 when the protective sleeve 200 is being removed. The diameter of the orifice 368 in the flexible cup 340 is also sufficient to substantially maintain the pressure boundary between the interior surface 556 and the exterior surface 560 (shown in FIG. 5) of the flexible cup 340 during plunging of a toilet bowl (not shown).

The orifice 368 of the flexible cup 340 can be positioned inside the inlet 344 in an upper portion 348 of the flexible cup 120. In this configuration, the orifice is substantially concentric with the inlet 344. However, the position of the orifice 368 may be located at another position in the flexible cup 120 in which the orifice 368 creates a passage between the exterior surface 132 and the interior surface 136 of the flexible cup 340. The diameter of the orifice 368 is large enough to allow the protective sleeve 200 to pass therethrough.

The protective sleeve 200 may then be passed from the orifice 368 through the through-hole 332 of the handle 104. The protective sleeve 200 may alternately be passed through a first opening 114 of the handle 104 (shown in FIG. 1). By passing the protective sleeve 200 through the through-hole 332, and then turning the protective sleeve 200 inside-out over the flexible cup 340, the protective sleeve 200 is oriented outside of the opening 140 such that the interior surface 308 faces the outside waste water environment, i.e., a dirty side. In this configuration, at least a lower portion 352 of the exterior surface 304' faces the exterior surface 132 of the flexible cup 340, and thereby, the flexible cup 340 is protected from the waste water environment, i.e., a clean side.

The exterior surface 304 of the protective sleeve 200 abuts the through-hole 332 as the protective sleeve 200 passes through the through-hole 332. The upper portion 348 of the protective sleeve 200 is advanced through through-hole 332 exposing the exterior surface 304 (the clean side) of the protective sleeve 200. The lower portion 352 of the protective sleeve 200 is positioned through the opening 140 of the flexible cup 340. As the protective sleeve 200 is pulled in a y-direction, the exterior surface 304 of the lower portion 352 of protective sleeve 200 is exposed to and may abut the interior surface 136 of the flexible cup 340. At the opening 140 of the flexible cup 340, the first tail 216 and second tail 220 are advanced upwardly proximate to the exterior surface 132 of the flexible cup 120 (i.e., advancing in a positive y direction). When the upper portion 348 of the protective sleeve 200 is pulled upwardly toward top portion 108 of handle 104 (e.g., advancing in a positive y direction), the first tail 216 and second tail 220 move toward the opening 140 of the flexible cup 340. The first tail 216 and second tail 220 may then be tied together trapping the dirty contaminated side, i.e., the interior surface 308 is enclosed. The clean surface, i.e., the exterior surface 304, is then free to be handled by a user for easy disposal of the protective sleeve 200. In this manner, the sanitary plunger 300 is not exposed or in contact with the waste water and already in a clean sanitary state after use.

Figure 4:
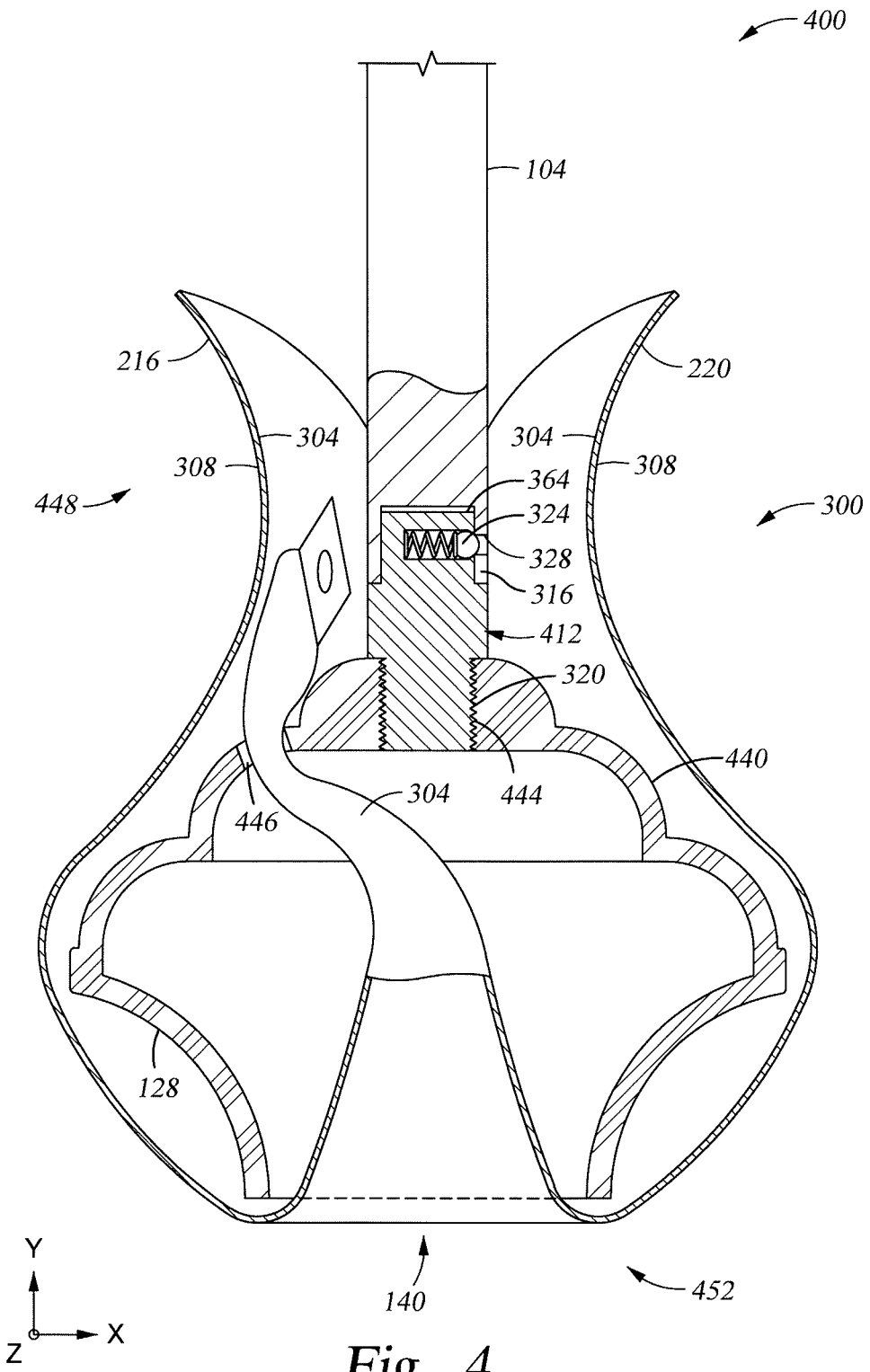
FIG. 4 is a side plan view of another sanitary plunger having the protective sleeve encasing the flexible cup according to another embodiment.

FIG. 4 is another example of the sanitary plunger 400 having the protective sleeve 200 encasing a flexible cup 440 according to another embodiment. The sanitary plunger 400 additionally has the handle 104 and a connector 412. The handle 104 and protective sleeve 200 are substantially the same as the described with reference to FIG. 3.

The connector 412 of the handle 104 may be configured with the first threaded portion 316 and the second threaded portion 320, as described above. The second threaded portion 320 is configured to be received by an inlet 444 of the flexible cup 440. The inlet 444 may be threaded. In some examples, the connector 412 may have the hollow section 148. However, the connector 412 may alternately be solid, or partially hollow.

The flexible cup 440 includes a through-hole 446. The through-hole 446 is configured to receive an upper portion 448 of the protective sleeve 200. The exterior surface 304 of the sleeve 200 abuts the through-hole 446 as the protective sleeve 200 passes through the through-hole 446. The upper portion 448 of the protective sleeve 200 includes a portion of the body 212. A lower portion 452 of the protective sleeve 200 is positioned through the opening 140 of the flexible cup 440. In a manner similar to that described above, when the upper portion 448 is pulled upwardly toward top portion 108 of handle 104 (e.g., advancing in a positive y direction), the first tail 216 and second tail 220 move toward the opening 140 of the flexible cup 440. The first tail 216 and second tail 220 are advanced out the through-hole 446. The first tail 216 and second tail 220 may then be tied together trapping the dirty contaminated side, i.e., the interior surface 308. The clean surface, i.e., the exterior surface 304, is free to be handled by a user for easy disposal of the protective sleeve 200. In this manner, the sanitary plunger 400 is not exposed or in contact with the waste water and thus remains in a clean sanitary state after use.

Figure 5:
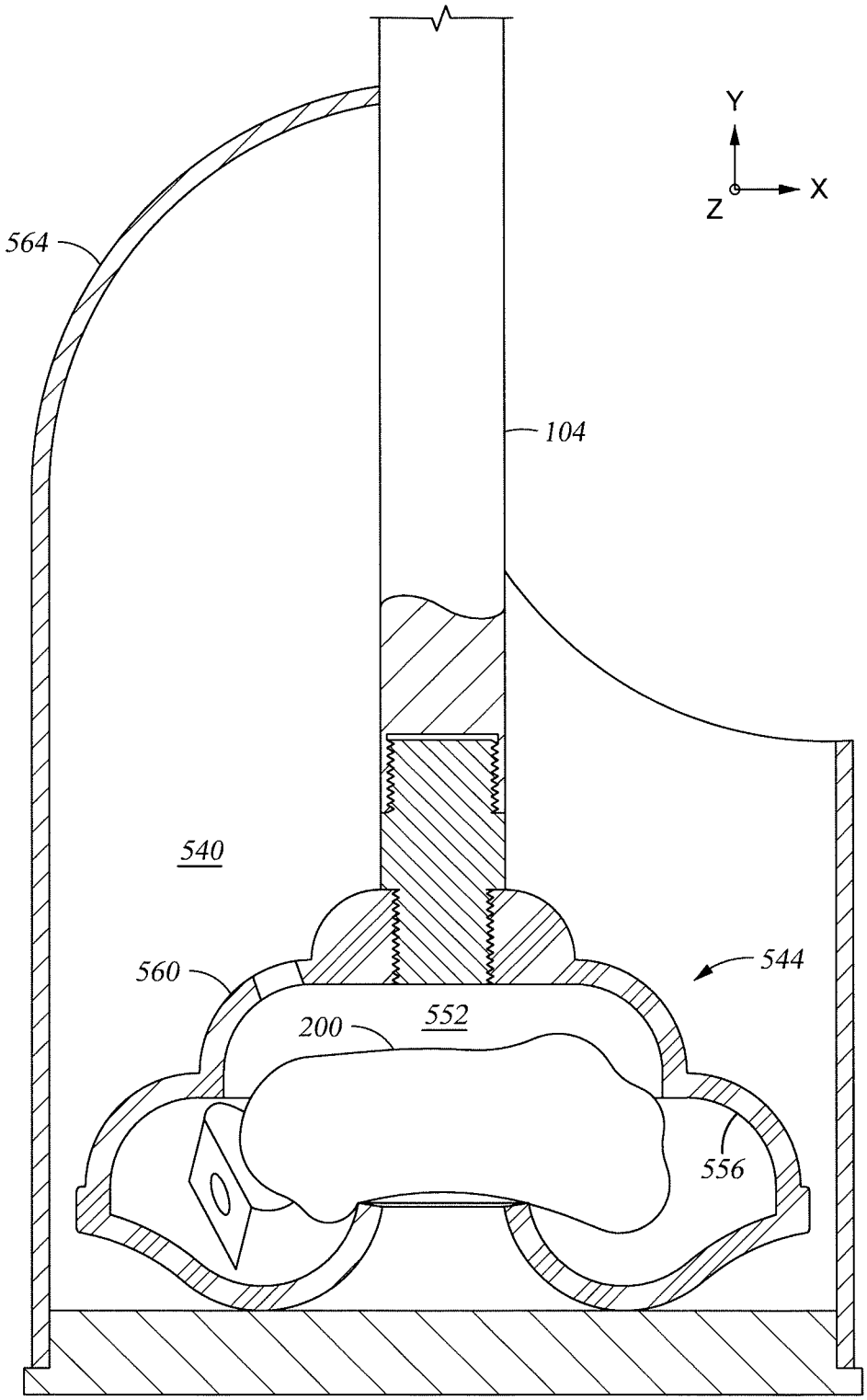
FIG. 5 is a side plan view of a sanitary plunger having the protective sleeve.

FIG. 5 is a side plan view of a sanitary plunger 500 having the protective sleeve 200. The sanitary plunger 500 includes a flexible cup 540 coupled to the handle 104. The flexible cup 540 has an upper base 544 and a lower base 548. The flexible cup 540 includes an internal surface 556 and an exterior surface 560. An internal space 552 is defined by the internal surface 556 and an imaginary plane that is coplanar to the opening 140 of the lower base 548 of the flexible cup 540.

The protective sleeve 200 can be stored within the internal space 552 of the flexible cup 540. During storage, the lower base 548 of the flexible cup 540 is inverted in a manner such that the internal surface 556 and the exterior surface 560 of the lower base 548 are positioned within the internal space 552 of the flexible cup 540. The lower base 548 is formed from a flexible material, such as rubber, silicon or other suitable elastomeric material. A biasing force caused by the flexible material in the lower base 548 of the flexible cup 540 pushes the protective sleeve 200 upwardly within the internal space 552. Friction between the internal surface 556 and the protective sleeve 200 prevents the protective sleeve 200 from slipping within the internal space 552. This frictional force retains the protective sleeve 200 within the internal space 552. A base portion 564 may be used to store the sanitary plunger 500. The base portion 564 is not limited to a particular shape or size, but is configured to enclose the flexible cup 120. In some examples, the base portion 564 is configured to cover at least the lower portion 352 of the handle 104.

Figure 6:
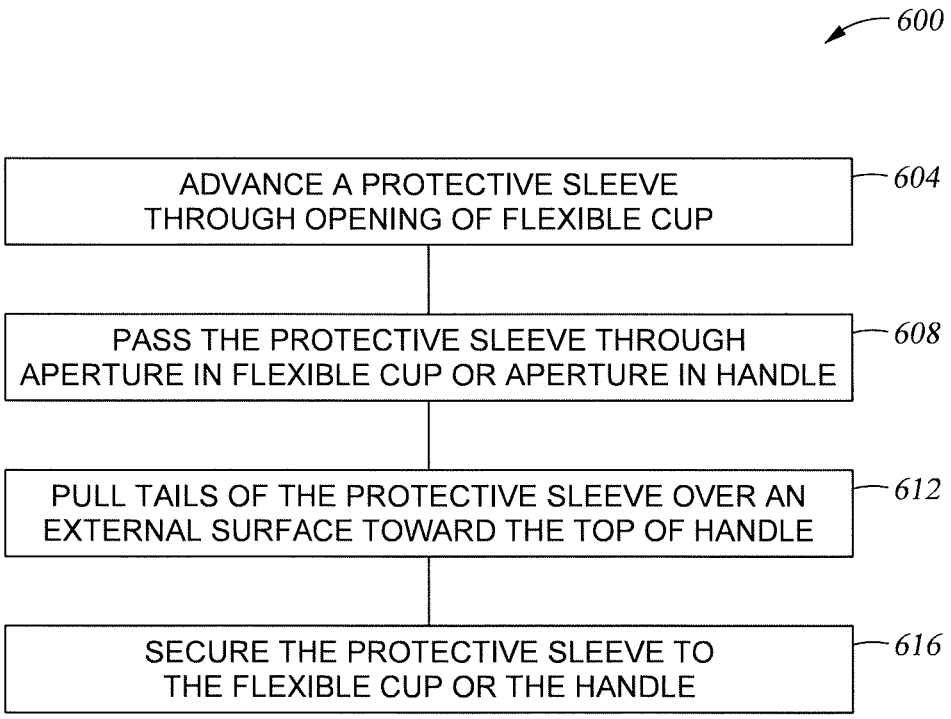
FIG. 6 is a flow diagram of an exemplary method for using the sanitary plunger.
Figure 7:
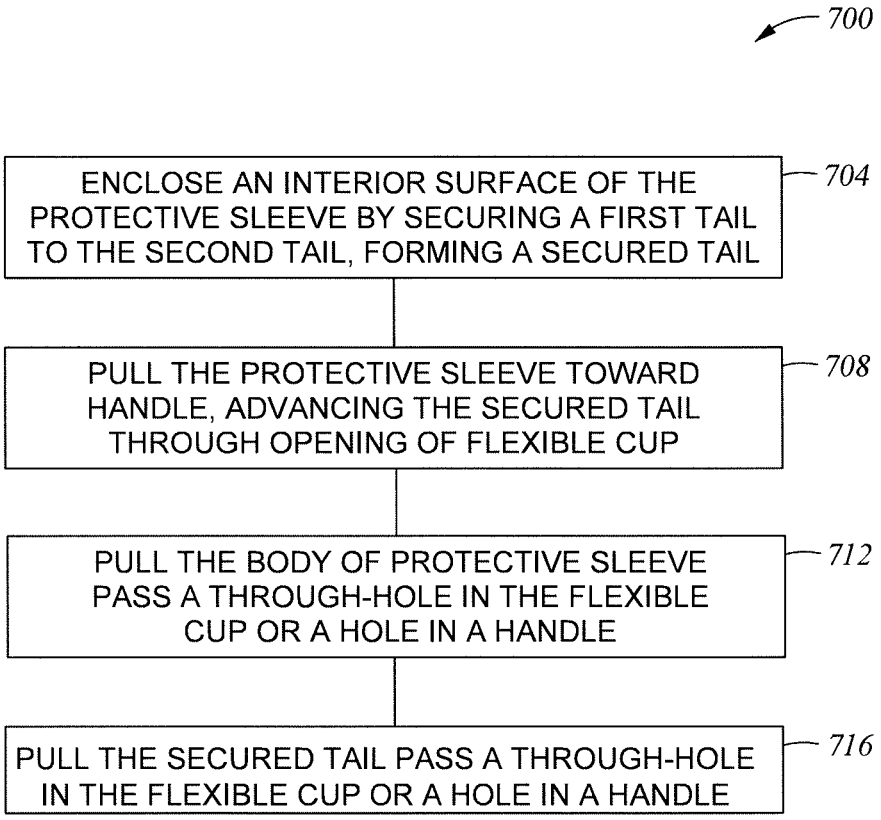
FIG. 7 is a flow diagram of an exemplary method for removing enclosed contaminants in the sanitary plunger.
Figure 8:
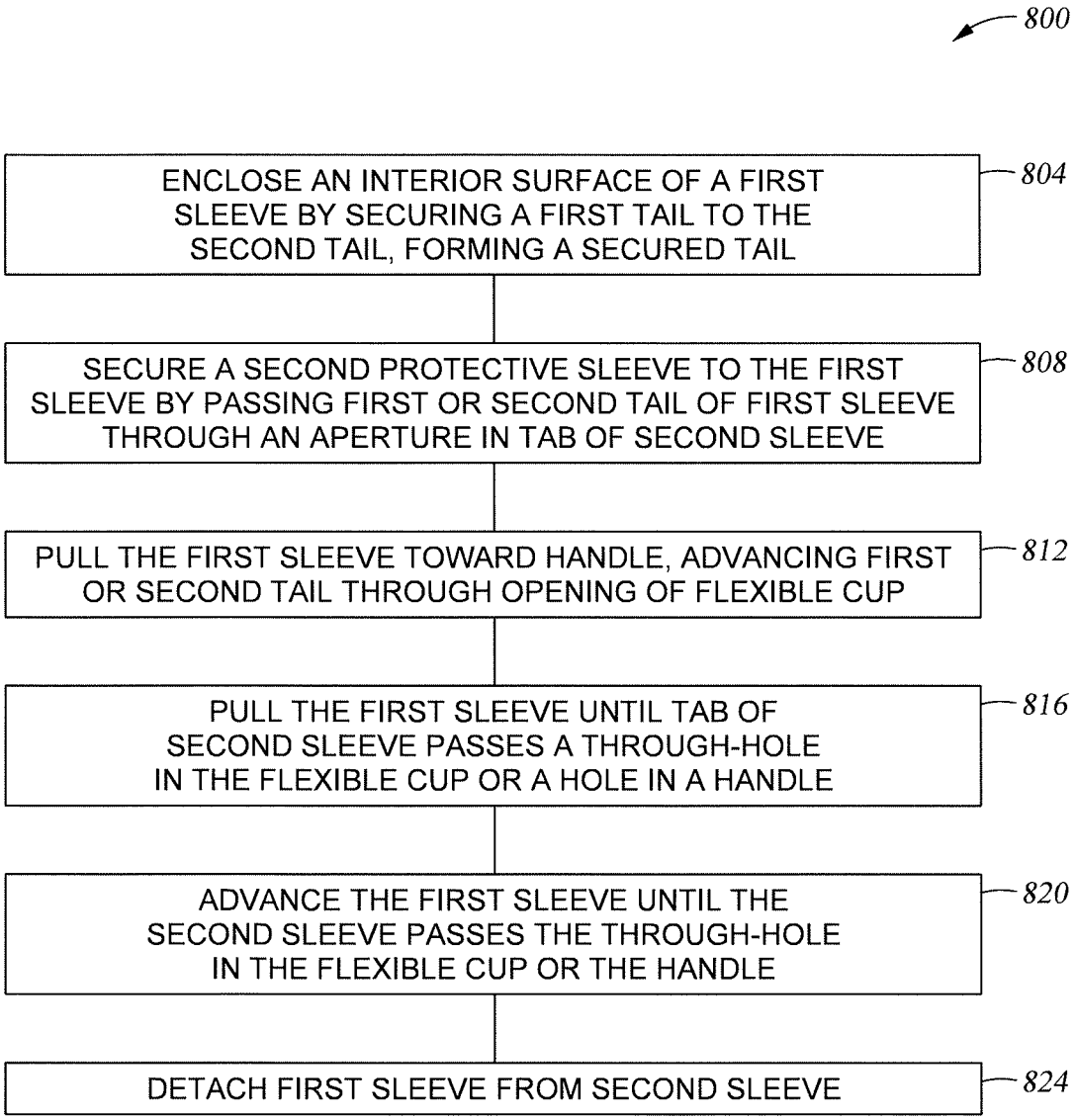
FIG. 8 is a flow diagram of an exemplary method for installing a new protective sleeve in the sanitary plunger.

FIGS. 6-8, discussed below, are flow diagrams of exemplary methods of utilizing the sanitary plungers, such as those disclosed above with in FIGS. 1-5. Prior to plunging of the toilet bowl, the protective sleeve 200 can be extended through one of the through-hole 332 or through-hole 446. If the protective sleeve 200 is a bag, or similar enclosing structure having one end sealed and one end open, the sealed end passes through through-hole 446 in the flexible cup 120. Extending the protective sleeve 200 through the through-hole 446 is accomplished by inserting the protective sleeve 200 through the opening 140 of the flexible cup 120 that is opposite the handle 104, and then passing the protective sleeve 200 through the through-hole 446.

The handle 104 may be solid, hollow, or partially hollow. With a solid handle 104 and the through-hole 446 in the side of the flexible cup 440, the protective sleeve 200 extends several inches beyond through-hole 446, such that an upper portion 448 of the protective sleeve 200 remains on the outside of the flexible cup 440. With a partially hollow or hollow handle 104 having a through-hole in a side of the handle 104, the through-hole 332 intersects the hollow cavity 116 in the handle 104. The protective sleeve 200 extends beyond the through-hole 332 in the handle 104. In this manner, the upper portion 348 of the protective sleeve 200 remains on the outside of the handle 104. With a hollow handle 104, the hollow cavity 116 extends from the top portion 108 to the bottom portion 112 of the handle 104. The protective sleeve 200 extends through the hollow cavity 116 at the bottom portion 112 to the top portion 108. A portion of the protective sleeve 200 extends several inches beyond the top portion 108 of the handle 104, for example by several inches, similar to the upper portion 448 illustrated in FIG. 4.

The upper portion 448 of the protective sleeve 200 extending beyond the through-hole 446 in the flexible cup 120 may be secured by a knot, or with a clip, clamp, or any type of seal that is sufficient to prevent water and contaminants from pushing through the tube when the toilet bowl is plunged. After the protective sleeve 200 is threaded through the flexible cup 120, the protective sleeve 200 is wrapped around the exterior surface 304 of the flexible cup 120 and extends along the handle 104 toward the top portion 108 of the handle 104. By encapsulating the flexible cup 120 and a portion of the handle 104 with the protective sleeve 200, a contamination barrier is created between the water in a toilet bowl (not shown) and the flexible cup 120. When a part of the sanitary plunger 300 is emerged during plunging, the length of the lower portion 352 of the protective sleeve 200 that extends toward the handle 104 is sufficiently long that the first tail 216 and second tail 220 are above the toilet bowl's water line. In this manner, water is prevented from flowing above an end (i.e., an inverted first tail 216 and second tail 220) of the protective sleeve 200 during plunging of the toilet bowl. When the first tail 216 or second tail 220 is inverted, the interior surface 308 of the protective sleeve 200 faces the outside, i.e., the positive x direction. The length of the protective sleeve 200 is also sufficient to enable the user to firmly secure the lower portion 352 of the protective sleeve 200 against the handle 104 when the flexible cup 120 is immersed in water during plunging of the toilet bowl.

FIG. 6 is a flow diagram of an exemplary method for using the sanitary plunger of FIGS. 1-2. According to the method 600 disclosed herein, at step 604, the protective sleeve 200 is passed through an opening 140 of the flexible cup 120. The method 600 continues at step 608 where the protective sleeve 200 is passed through a through-hole 332 in the handle 104 or a through-hole 446 in the flexible cup 440. At step 612, the first tail 216 and second tail 220 are pulled along the exterior surface 132 of the flexible cup 120 toward a top portion 108 of the handle 104. The method continues to step 616, where the protective sleeve 200 is secured the external surface 152 of the handle 104. The protective sleeve 200 may be secured to the handle 104 or the flexible cup 120 by using a clip or tie, or any other suitable techniques that securely attaching the protective sleeve 200 to the handle 104 or flexible cup 120. The protective sleeve 200 may also be held in the hand of the user or compressed against the handle 104, thereby securing the protective sleeve 200 in another example.

After plunging, the user may firmly hold the handle 104 with one hand and reach with an opposite hand along the handle 104 to grasp the exterior surface 304 near the upper portion 348 (e.g. a leading portion) of the protective sleeve 200. The protective sleeve 200 is pulled in the positive y direction causing the body 212 of the protective sleeve 200 to be pulled through the opening 140 of the flexible cup 120. The protective sleeve 200 is turned "outside-in," exposing both the upper portion 348 and the lower portion 352 (e.g. a trailing portion) of the third external wall 260 of the body 212 to the outside. In this manner, the contaminated water and debris are encapsulated on an inside of the protective sleeve 200. When several inches of the protective sleeve 200 still remain on the outside of the flexible cup, the user may choose to substantially seal the end of the protective sleeve 200 with a knot, clamp, clip or some other method. Accordingly, the contaminants on the internal wall 214 are securely enclosed during handling and disposal of protective sleeve 200.

FIG. 7 is a flow diagram of an exemplary method for removing enclosed contaminants in the sanitary plunger of FIGS. 1 and 2. The method 700 of removing a protective sleeve 200 begins at step 704. At step 704, the internal wall(s) 214 of the protective sleeve 200 is enclosed by securing the first tail 216 to the second tail 220. At step 708, the protective sleeve 200 is pulled until the secured first tail 216 and second tail 220 pass through the opening 140 of the flexible cup 120. At step 712, the body 212 of protective sleeve 200 is pulled until the body 212 passes the through-hole 446 in the flexible cup or through-hole 332 in the handle 104. The method 700 continues at step 716, where the secured first tail 216 and second tail 220 continue to be pulled until tips 248 of the first and second tails 216 and 220 are advanced through a through-hole 332 in the handle 104 or a through-hole 446 in the flexible cup 440.

A user may advance a new protective sleeve 200' on the sanitary plunger 100, each time the sanitary plunger is used. The new protective sleeve 200' may have substantially the same configuration as the protective sleeve 200 illustrated in FIG. 2. In some examples, either the used protective sleeve 200 or the new protective sleeve 200' may have a different configuration. For example, the protective sleeve 200 may be configured without tails 216 or 220, the shoulder 208, or tab 204. The protective sleeve 200 may be any shape or configuration so long as the protective sleeve 200 is configured to be advanced through the handle 104 or flexible cup 120, and cover the plunger 100, as shown in FIGS. 3-4. The aperture 206 in the tab 204 can be used to advance the new protective sleeve 200'. The aperture 206 of the new protective sleeve 200' may also be attached to a tie, hook, clamp, or any other structure that can pass through the aperture 206. When the user advances the used protective sleeve 200 in order to be removed, several inches of the used protective sleeve 200 may remain on the outside of the flexible cup 120 at or near the opening 140. The tab 204 of the new protective sleeve 200' is secured to at least one of the first tail 216 or second tail 220 of the used protective sleeve 200.

Once the new protective sleeve 200' is secured to the used protective sleeve 200, the user continues to advance used protective sleeve 200 until the new upper portion 348 of the new protective sleeve 200' passes the through-hole 446 in the flexible cup 120, or one the through-hole (332) in the handle 104 or first opening 114 in the handle 104. The user separates the used protective sleeve 200 from the new protective sleeve 200'. The used protective sleeve 200 may then be disposed. The user may then store the new protective sleeve 200' in the internal space 552 of the flexible cup 540 until the next use. For subsequent uses, the new protective sleeve 200' may be installed as described above.

FIG. 8 is a flow diagram of an exemplary method for installing a new protective sleeve in the sanitary plunger. The method 800 of replacing the protective sleeve 200 begins at step 804. At step 804, the internal wall(s) 214 of the protective sleeve 200 is enclosed by securing the first tail 216 to the second tail 220. The method 800 continues at step 808 when a second protective sleeve 200 is secured to a first protective sleeve 200 by passing the first tail 216 or second tail 220 through the aperture 206 in the second protective sleeve 200. At step 812, the protective sleeve 200 is pulled until the secured first tail 216 and second tail 220 pass through the opening 140 of the flexible cup 120. The method 800 continues at step 816, where the secured first tail 216 and second tail 220 continue to be pulled outwardly until tips 248 of the first and second tails 216 and 220 are advanced beyond the through-hole 332 in the handle 104 or a through-hole 446 in the flexible cup 440. The first protective sleeve 200 is pulled until tab of new protective sleeve 200 passes the through-hole 332 in the handle 104 or a through-hole 446 in the flexible cup 440. At step 820, the body 212 of first protective sleeve is advanced until the body 212 of the upper portion 448 of second protective sleeve 200 passes the through-hole 446 in the flexible cup 440, or a through-hole 332 in the handle. The method 800 ends at step 824 when the first protective sleeve 200 is detached from the second protective sleeve 200.

Figure 9:
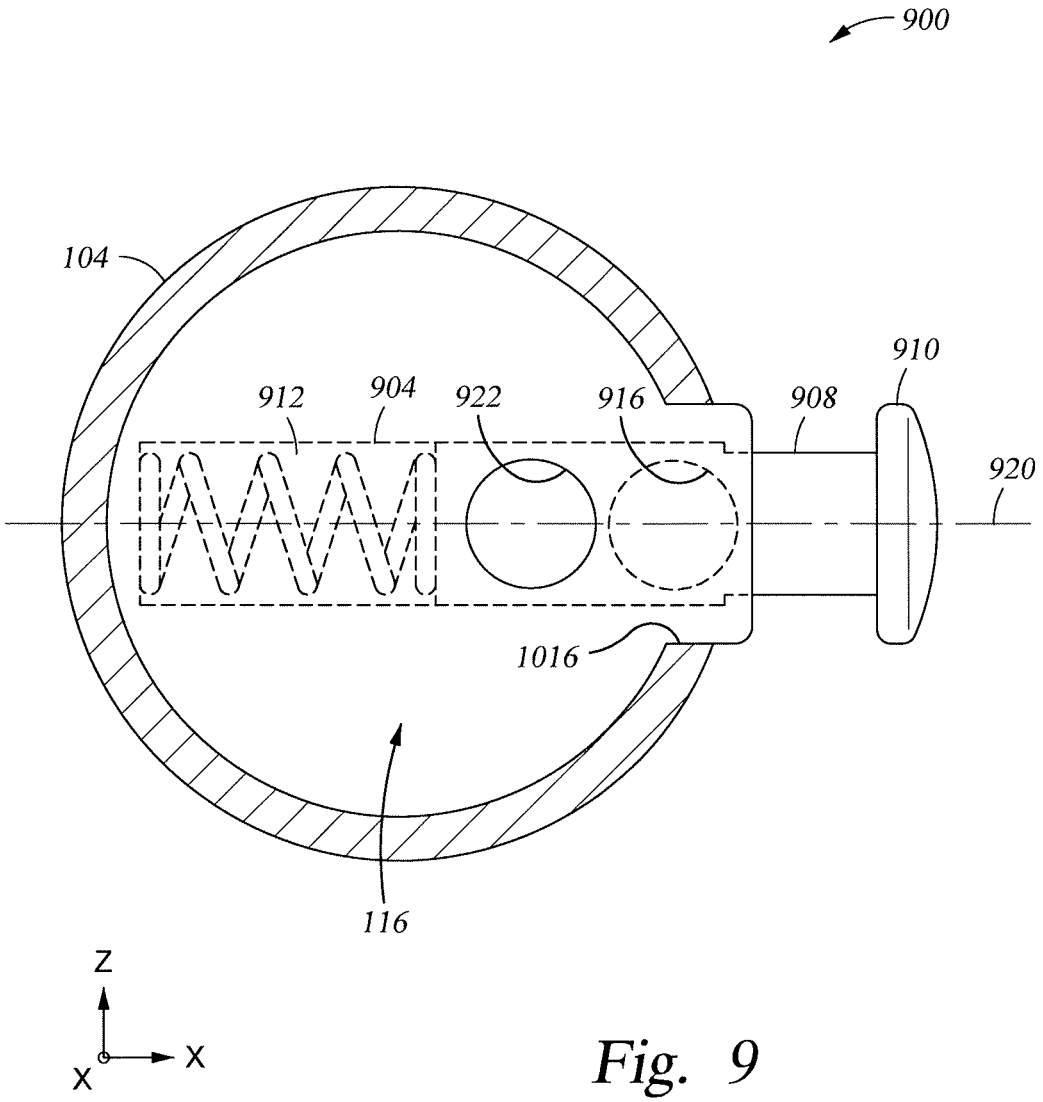
FIG. 9 is a side plan view of a valve disposed in a handle of a sanitary plunger.

FIG. 9 is a side plan view of a valve disposed in a handle of a sanitary plunger. The valve 900 is configured to be disposed in the hollow cavity 116 of the handle 104 having an opening 1016 (discussed below). Herein, the hollow cavity 116 includes the hollow section 148, as illustrated in FIG. 1. The valve 900 includes a body 904 having a first through-hole 916. A stem 908, having a second through-hole 922, passes through the body 904. A head 910 is connected to the stem 908, in such a manner that the head 910 can extend outside of the body 904. A seat 912 is positioned opposite the stem 908. The seat 912 and stem 908 are aligned along an axis 920. The valve 900 may be placed in the connector 144 of the handle 104 in a manner that at least the body 904 is disposed in the hollow cavity 116. In this manner, the head 910 is positioned on an outside of the external surface 152 of the handle 104.

The first through-hole 916, with a centerline that is approximately perpendicular to an axis 920, extends through the stem 908. A second through-hole 922, with a centerline that is approximately perpendicular to axis 920, extends through body 904. The centerlines of first through-hole 916 and the second through-hole 922 substantially align when the head 910 of the valve 900 is pressed into the hollow cavity 116 of the handle 104. Advantageously, the valve 900 is configured to apply a biasing force, such that when the protective sleeve 200 is positioned within the first and second through-holes 916 and 920, the internal walls 214 of the protective sleeve 200 compress, in a manner that substantially prevents water from entering the upper portion 348 of the protective sleeve 200 when the sanitary plunger 100 is in use.

Figure 10:
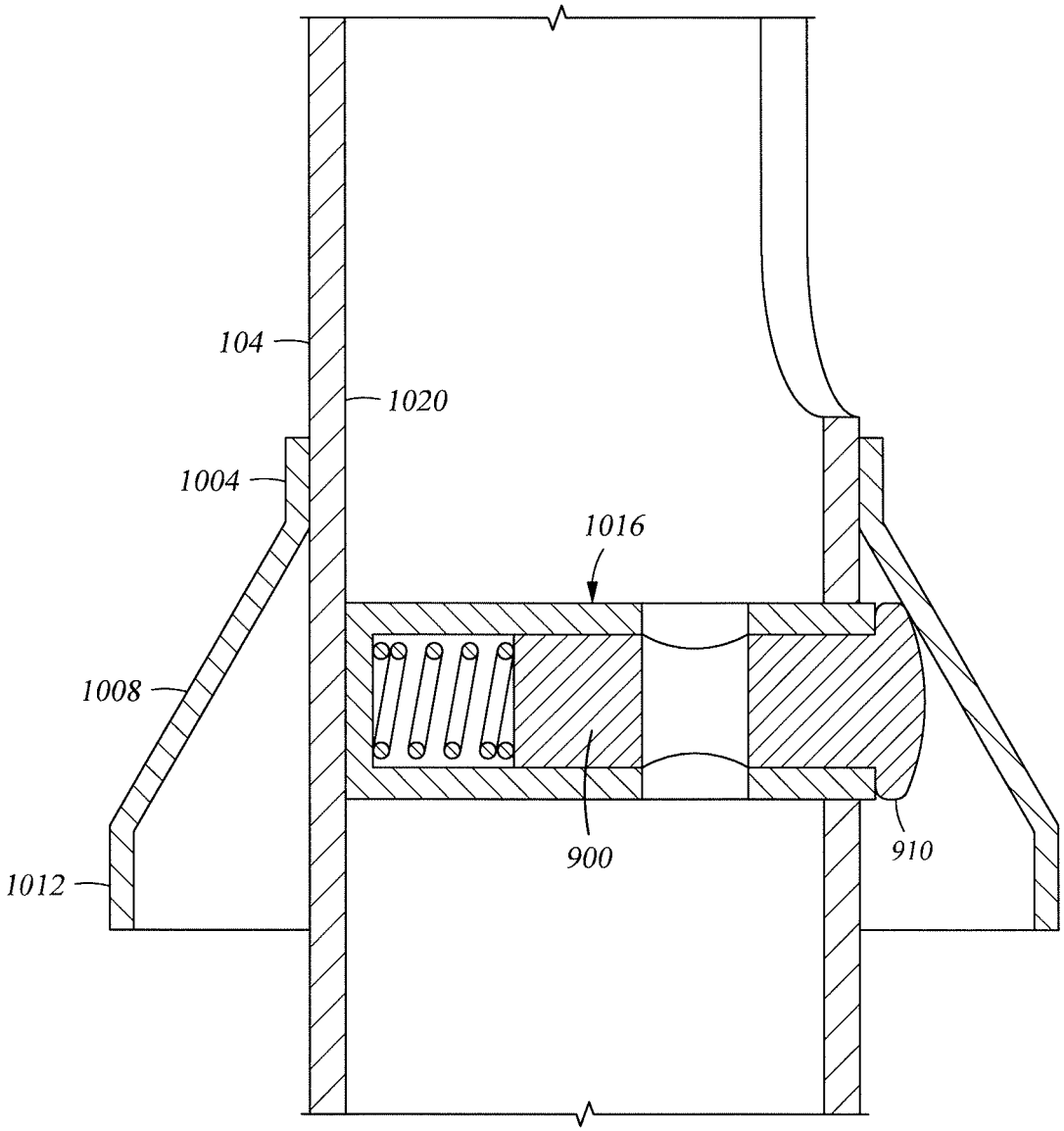
FIG. 10 is a plan view of an exemplary sliding member configured to surround the handle of the sanitary plunger of FIG. 9.

FIG. 10 is a plan view of an exemplary sliding member configured to surround the handle of the sanitary plunger of FIG. 9. The sliding member 1000 has locking member 1004, a skirt 1008, and a rim 1012. The skirt 1008 and rim 1012 are configured to accommodate the upper base 124 of the flexible cup 120. As illustrated, the skirt 1008 may be conical, however the shape of the skirt 1008 may be any shape configured to accommodate the upper base 124. As such, the skirt 1008 may also be in the shape of a pyramid, cuboid, or cone, any of which may be truncated. The sliding member 1000 is rotatable around the y axis, and is configured to slide on the handle 104 in a positive and negative y direction.

Figure 11:
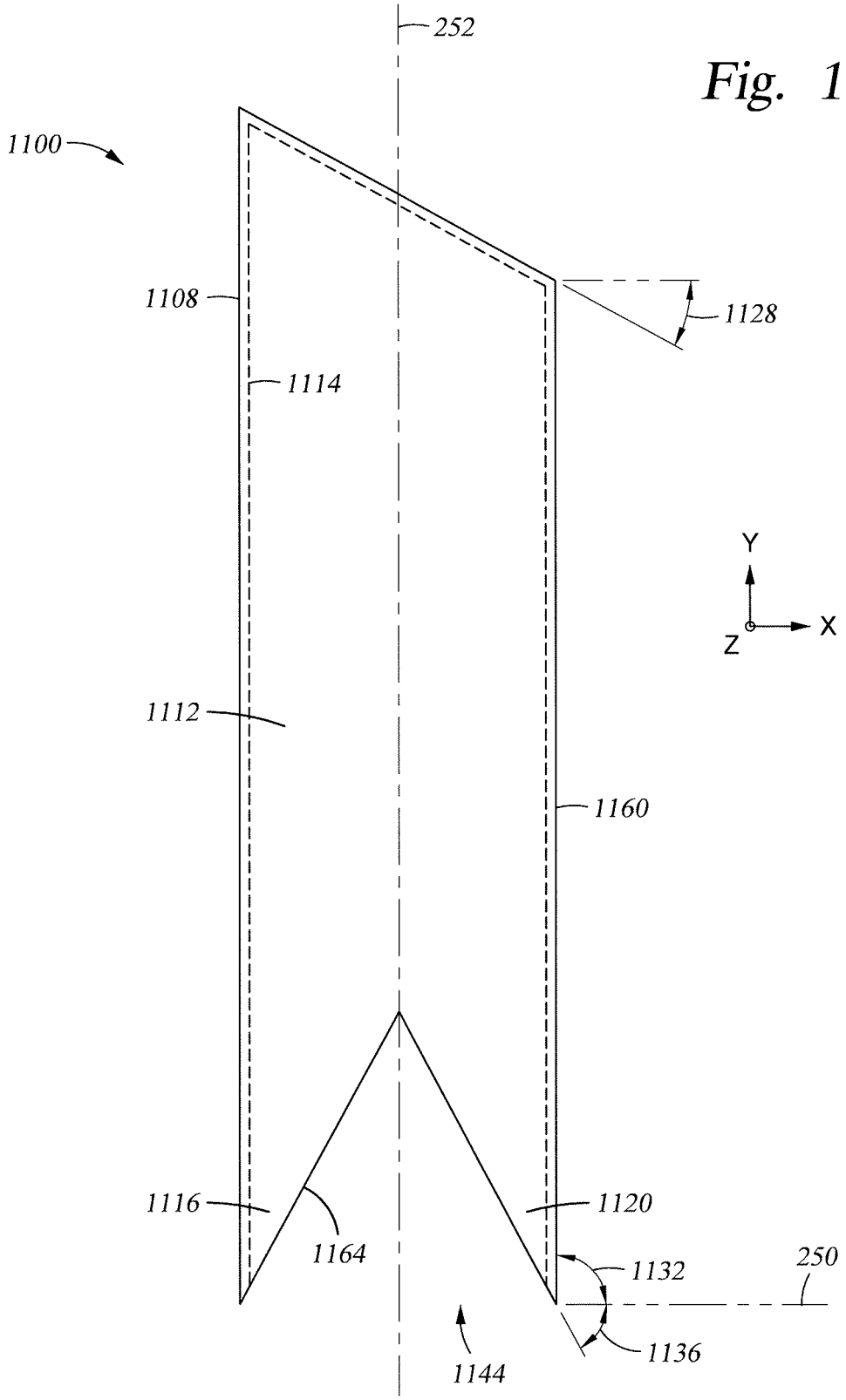
FIG. 11 is a schematic side plan view of an alternate embodiment the protective sleeve illustrated in FIG. 2.

FIGS. 11-14 are schematic side plan views of alternate embodiments of the protective sleeve illustrated in FIG. 2. FIG. 11 is a schematic side plan view of an alternate embodiment the protective sleeve 200 illustrated in FIG. 2. A protective sleeve 1100 has a shoulder 1108, a body 1112, and a first tail 1116 and a second tail 1120. A center line 252 substantially bisects the protective sleeve 1100, and an imaginary line 250 is orthogonal to the center line 252. A first angle 1128 is formed between a first external wall 1156 of the shoulder 1108 and the imaginary line 250. In some examples, the first angle 1128 may form an acute angle that is less than 90 degrees.

The body 1112 of the protective sleeve 1100 includes an internal wall 1114 and a second external wall 1160. A second angle 1132 is formed between the second external wall 1160 and the imaginary line 250. In some examples, the second angle 1132 may be a second obtuse angle greater than 90 degrees. In the example illustrated, the second angle 1132 is greater than the first angle 1128. However, the protective sleeve 1100 is not limited to that configuration.

An opening 1144 in the body 1112 of the protective sleeve 1100 enables access to the internal wall 1114. A third angle 1136 is formed between the imaginary line 250 and a third external wall 1164 of the first tail 1116. The third angle 1136 is mirrored across the opening 1144 and additionally formed between the imaginary line 250 and third external wall 1164 of the second tail 1120. In this example, the third angle 1136 forms an acute angle with the imaginary line 250.

Figure 12:
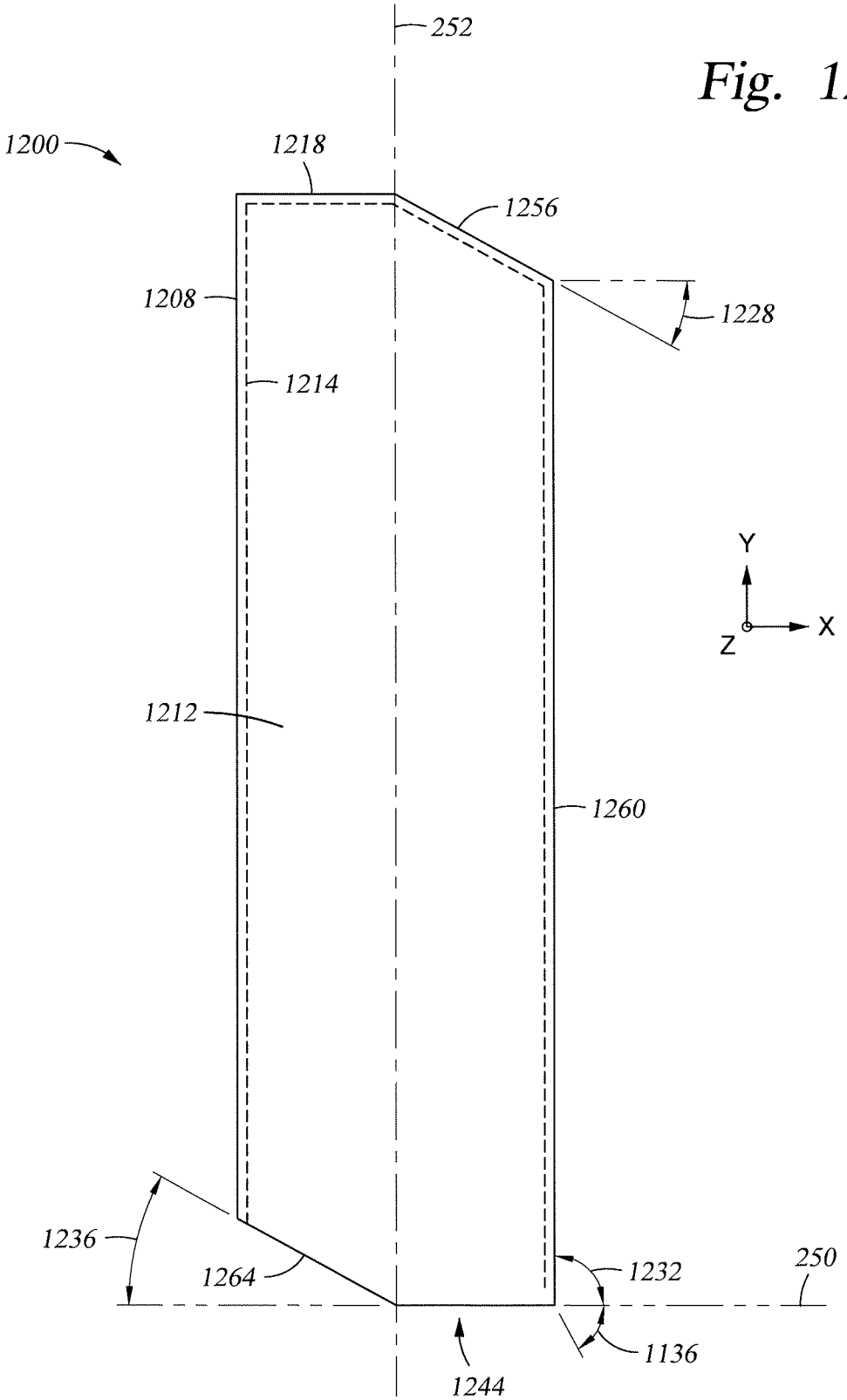
FIG. 12 is a schematic side plan view of another alternate embodiment the protective sleeve illustrated in FIG. 2.

FIG. 12 is a schematic side plan view of another alternate embodiment the protective sleeve 200 illustrated in FIG. 2. A protective sleeve 1200 has a shoulder 1208 and a body 1212. A center line 252 substantially bisects the protective sleeve 1200, and an imaginary line 250 is orthogonal to the center line 252. A first external wall 1218 is substantially orthogonal to the center line 252. A first angle 1228 is formed between a second external wall 1256 of the shoulder 1208 and the imaginary line 250. In some examples, the first angle 1228 may form an acute angle that is less than 90 degrees.

The body 1212 of the protective sleeve 1200 includes an internal wall 1214 and a third external wall 1260. A second angle 1232 is formed between the third external wall 1260 and the imaginary line 250. In some examples, the second angle 1232 may be greater than or equal to 90 degrees. In the example illustrated, the second angle 1232 is greater than the first angle 1228. However, the protective sleeve 1200 is not limited to that configuration.

An opening 1244 in the body 1212 of the protective sleeve 1200 enables access to the internal wall 1214. A third angle 1236 is formed between the imaginary line 250 and a third external wall 1264. In this example, the third angle 1236 forms an acute angle with the imaginary line 250. The second external wall 1256 can be parallel to the third external wall 1264. However, the protective sleeve 1200 is not limited to that configuration.

Figure 13:
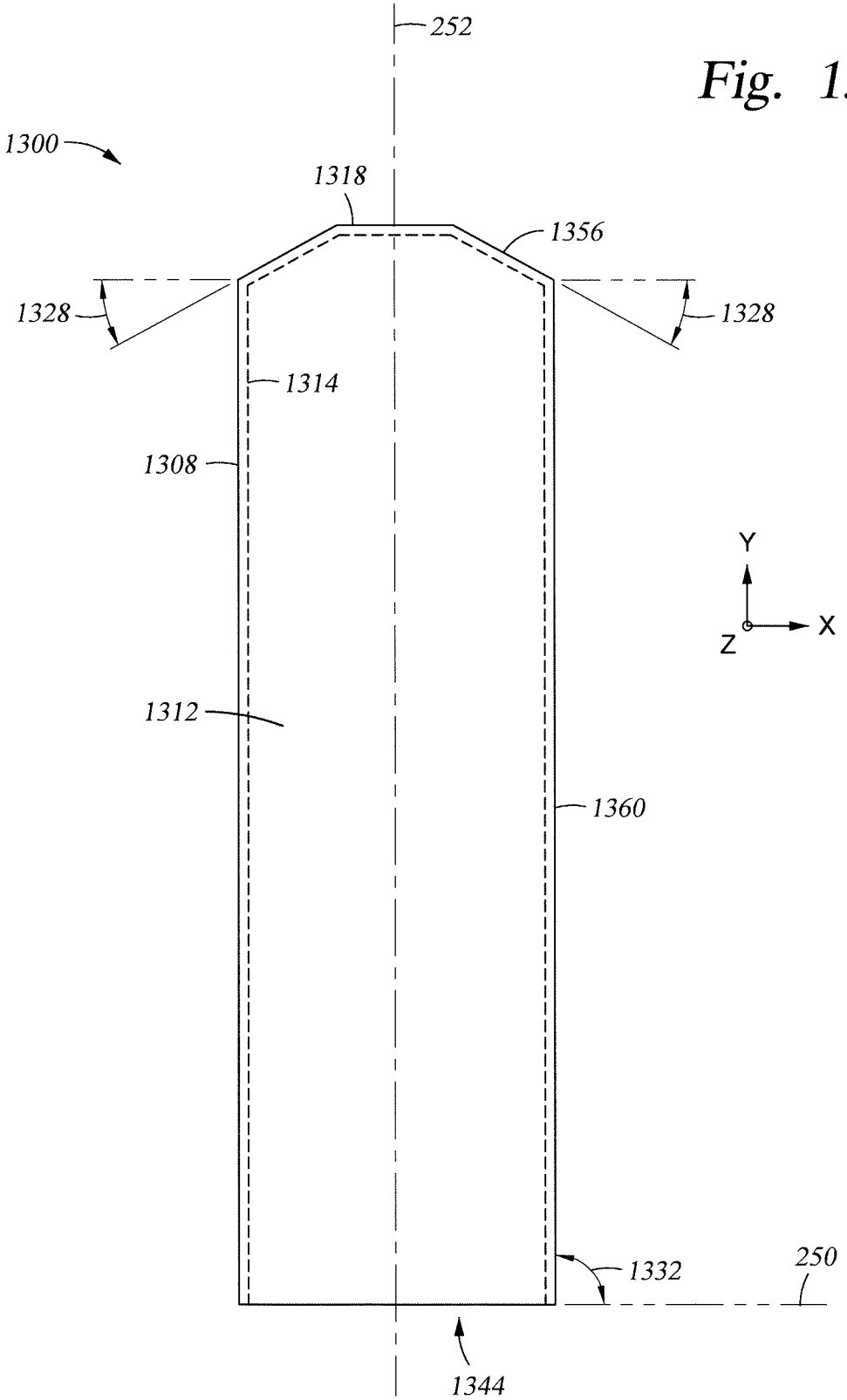
FIG. 13 is a schematic side plan view of yet another alternate embodiment the protective sleeve illustrated in FIG. 2.

FIG. 13 is a schematic side plan view of yet another alternate embodiment the protective sleeve 200 illustrated in FIG. 2. A protective sleeve 1300 has a shoulder 1308 and a body 1312. A center line 252 substantially bisects the protective sleeve 1300, and an imaginary line 250 is orthogonal to the center line 252. A first external wall 1318 is substantially orthogonal to the center line 252. A first angle 1328 is formed between a first external wall 1356 of the shoulder 1308 and the imaginary line 250. In some examples, the first angle 1328 may form an acute angle that is less than 90 degrees.

The body 1312 of the protective sleeve 1300 includes an internal wall 1314 and a second external wall 1360. A second angle 1332 is formed between the second external wall 1360 and the imaginary line 250. In some examples, the second angle 1332 may be greater than or equal to 90 degrees. In the example illustrated, the second angle 1332 is greater than the first angle 1328. As illustrated, the shoulder 1308 forms an isosceles trapezoid and the first external wall 1456 is mirrored about the center line 252. However, neither the protective sleeve 1300 nor the shoulder 1308 is limited to the configuration illustrated. An opening 1344 in the body 1312 of the protective sleeve 1300 enables access to the internal wall 1214. However, the protective sleeve 1300 is not limited to that configuration.

Figure 14:
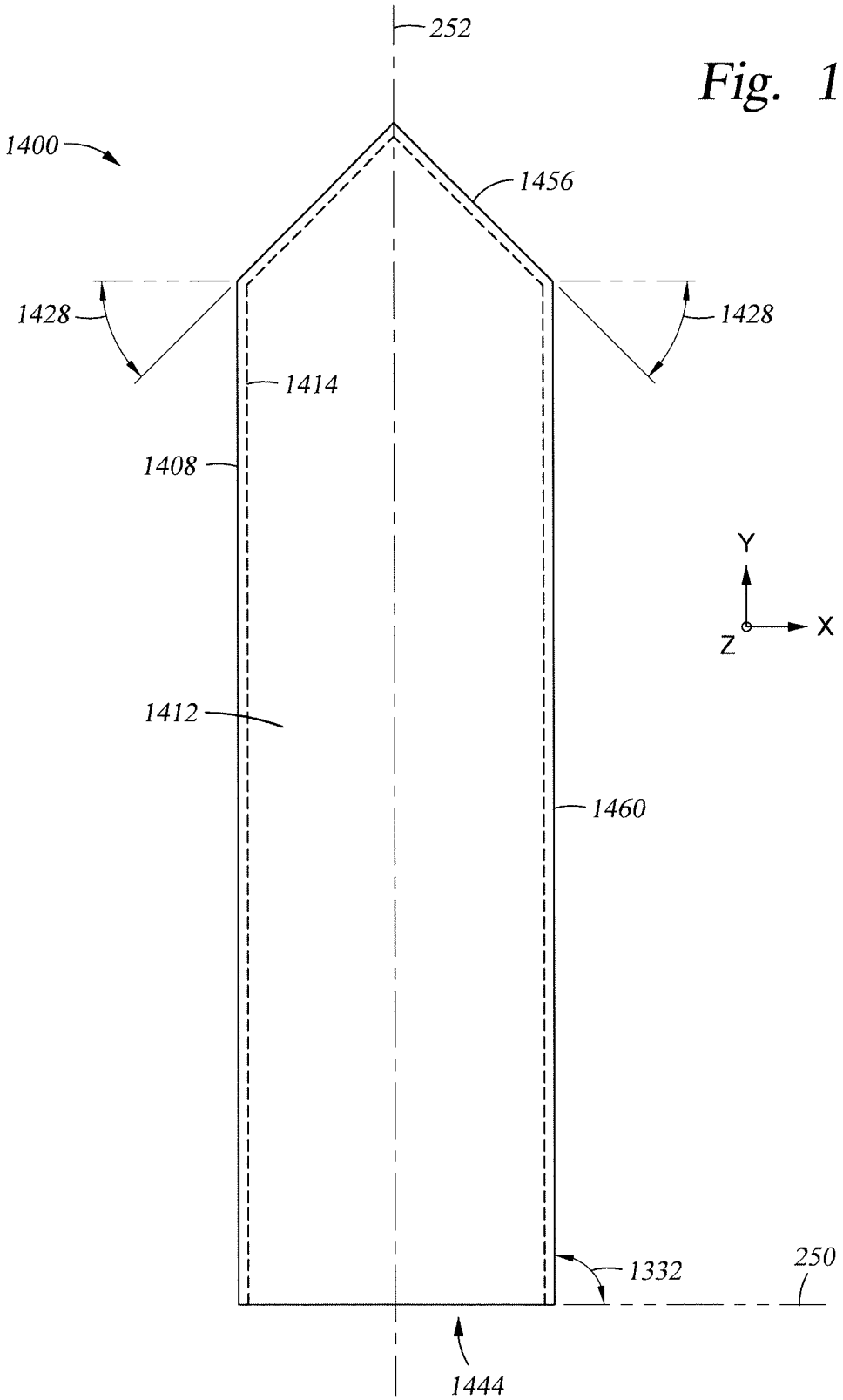
FIG. 14 is a schematic side plan view of another embodiment the protective sleeve illustrated in FIG. 2.

FIG. 14 is a schematic side plan view of another embodiment the protective sleeve 200 illustrated in FIG. 2. A protective sleeve 1400 has a shoulder 1408 and a body 1412. A center line 252 substantially bisects the protective sleeve 1400, and an imaginary line 250 is orthogonal to the center line 252. A first angle 1428 is formed between a first external wall 1456 of the shoulder 1408 and the imaginary line 250. In some examples, the first angle 1428 may form an acute angle that is less than 90 degrees. As illustrated, the shoulder 1408 forms an isosceles triangle and the first external wall 1456 is mirrored about the center line 252. However, the shoulder 1408 is not limited to that configuration.

The body 1412 of the protective sleeve 1400 includes an internal wall 1414 and a second external wall 1460. A second angle 1432 is formed between the second external wall 1460 and the imaginary line 250. In some examples, the second angle 1432 may be greater than or equal to 90 degrees. In the example illustrated, the second angle 1432 is greater than the first angle 1428. However, the protective sleeve 1400 is not limited to that configuration. An opening 1444 in the body 1412 of the protective sleeve 1400 enables access to the internal wall 1414; however, the protective sleeve 1400 is not limited to that configuration.

Figure 15:
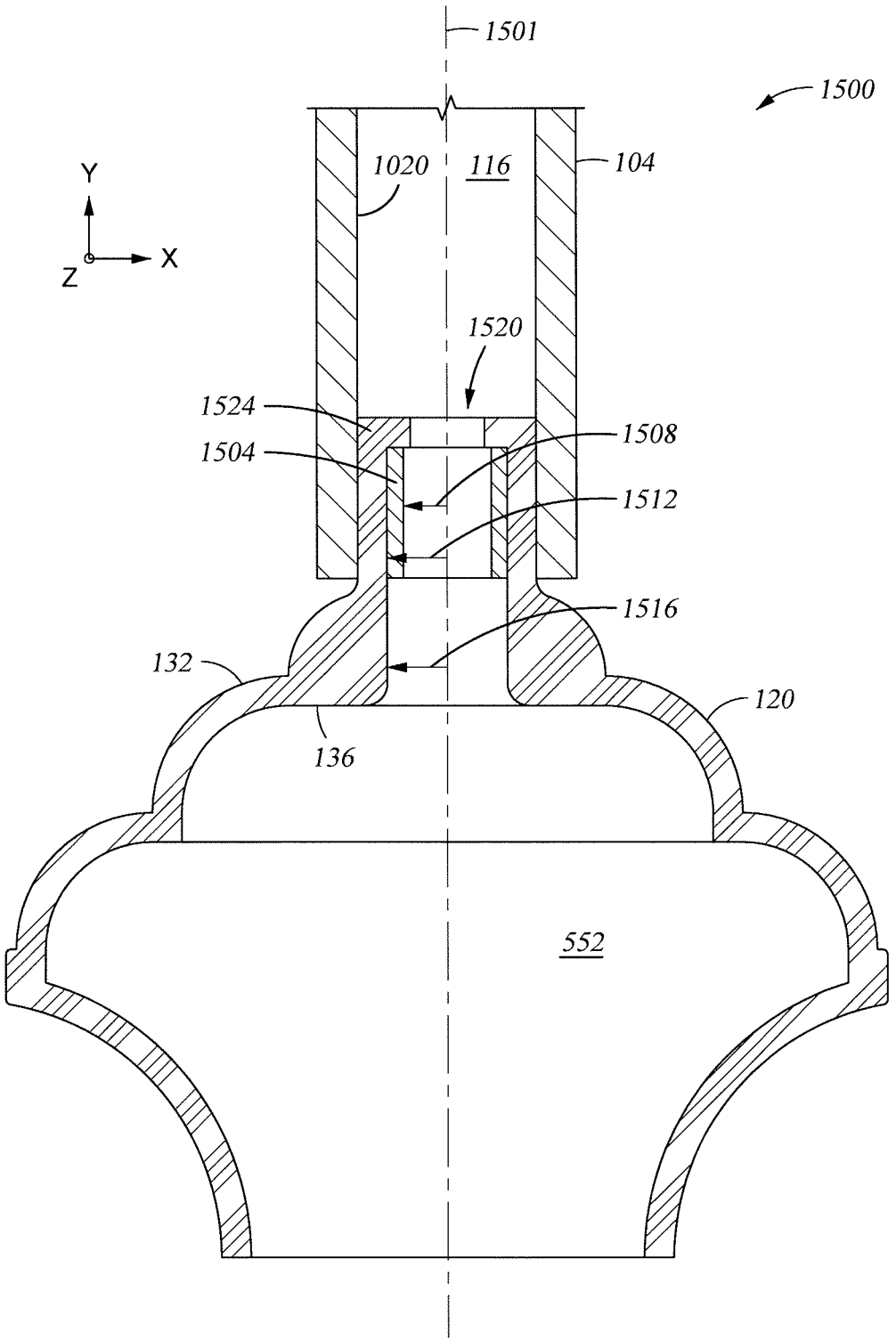
FIG. 15 is a schematic side plan view of a sanitary plunger having a handle coupled to a flexible cup.

FIG. 15 is a schematic side plan view of a sanitary plunger 1500 having a handle 104 coupled to a flexible cup 120. A center line 1501 is shown bisecting the handle 104 and the flexible cup 120 that is coupled to the handle 104. The flexible cup 120 has a fitting portion 1524 that extends into the hollow cavity 116 of the handle 104. The fitting portion 1524 has a fitting radius 1516. The interior surface 136 of the flexible cup 120 extends into the fitting portion 1524 and terminates at a top opening 1520. The top opening 1520 couples the hollow cavity 116 of the handle 104 to the internal space 552 of the flexible cup 120. The top opening 1520 is an area having a radius (not show) that is configured to receive the protective sleeve 200, as illustrated in FIG. 2, or any of the alternative embodiments illustrated in FIGS. 11-14.

A biasing member 1504 is positioned within the fitting portion 1524 of the flexible cup 120. The biasing member 1504 has an inner radius 1508 and an outer radius 1512. The inner radius 1508 of the biasing member 1504 is larger than the radius of the top opening 1520 of the flexible cup 120. It should be appreciated however, that the inner radius 1508 and the radius of the top opening 1520 may also align. Stated differently, the inner radius 1508 of the biasing member 1504 may be substantially the same as the radius of the top opening 1520. The outer radius 1512 is larger than the fitting radius 1516, and smaller than a radius extending from the center line 1501 to the internal wall 1020 of the handle 104.

As mentioned above, the flexible cup 120 can be made from an elastomeric material such as rubber or silicon. Accordingly, the biasing member 1504 compresses the fitting portion 1524 to the internal wall 1020 of the handle 104, thus coupling the handle 104 to the flexible cup 120. Friction between the exterior surface 132 of the flexible cup 120 and the internal wall 1020 of the handle 104 substantially prevents the flexible cup 120 from slipping away and dislodging from the handle 104.

Thus, the method and apparatus described herein include a protective sleeve that shields the head of a plunger from contaminants. While the foregoing is directed to specific examples, other examples may be devised without departing from the basic scope thereof, and the scope thereof is determined by the claims that follow.

What is claimed is:

1. An apparatus for enclosing contaminants, the apparatus comprising:

a plunger comprising:

a handle having a first end and a second end; and a flexible cup coupled to the first end of the handle, the flexible cup having an interior surface and an exterior surface;

a protective sleeve comprising:

a body made from a flexible non-permeable material, the body having an internal wall and an external wall; and an inlet on the exterior surface of the flexible cup, the inlet coupled to a connector, the connector coupled to the handle;

a through-hole configured to receive the body of the protective sleeve by passing a portion of the body through an opening in the flexible cup, the through-hole is located in the flexible cup offset from the inlet, in an external surface of the handle, or in a top portion of the handle.

2. The apparatus for enclosing contaminants as recited in claim 1, wherein the connector further comprises:

a first threaded portion and a second threaded portion, wherein the first threaded portion has a first circumference that is greater than a second circumference of the first threaded portion.

3. The apparatus for enclosing contaminants as recited in claim 1, wherein the handle comprises:

a hollow center extending from the first end of the handle, and an eyelet extending from a surface of the handle toward the hollow center, wherein the connector comprises:

a first portion having a first radius, and a second portion having a second radius that is less than the first radius; and a protrusion in the first portion that is configured to extend through the eyelet, securing the connector to the handle.

4. The apparatus for enclosing contaminants as recited in claim 1, wherein the flexible cup comprises:

an upper base and a lower base, wherein an opening of the lower base is configured to fold inside an internal space of the upper base, and the body of the protective sleeve is secured within the internal space by an interior surface of the lower base.

5. The apparatus for enclosing contaminants as recited in claim 1, wherein the body further comprises:

a tab, a shoulder region, a central portion, a first tail, and a second tail, the shoulder region and the central portion of the protective sleeve forming an obtuse angle, the first tail of the protective sleeve and an imaginary line extending from a tip of the first tail to a tip of the second tail, forming an acute angle.

6. The apparatus for enclosing contaminants as recited in claim 5, wherein the protective sleeve further comprises:

a centerline passing through an aperture of the tab, the centerline passing through a cut-out portion, wherein the first tail and second tail are symmetric about the centerline.

7. The apparatus for enclosing contaminants as recited in claim 1, comprising:

a base portion configured to store the plunger, wherein the base portion is also configured to enclose the flexible cup and at least a lower portion of the handle adjacent the flexible cup.

8. The apparatus for enclosing contaminants as recited in claim 1, further comprising:

a valve disposed within the handle.

9. An apparatus for enclosing contaminants, the apparatus comprising:

a plunger comprising:

a handle having a first end and a second end;

a flexible cup attached to the handle, the flexible cup having an interior surface and an exterior surface, an inlet on an external surface of the flexible cup, the inlet coupled to a connector, the connector coupled to the handle; and a through-hole in the handle or the flexible cup;

a protective sleeve, configured to cover the flexible cup, the protective sleeve comprising:

a body made from a flexible non-permeable material, the body having an internal wall and an external wall, wherein the body further includes a tab, a shoulder region, a central portion, a first tail, and a second tail, wherein the first tail and second tail of the protective sleeve are configured to be pulled over the exterior surface of the flexible cup, and the first tail and second tail are used to secure an upper portion of the protective sleeve to the handle or the flexible cup, wherein the body of the protective sleeve is configured to advance through the through-hole in the flexible cup or the handle by passing the tab through an opening of the flexible cup.

10. The apparatus for enclosing contaminants as recited in claim 9, wherein the connector further comprises:

a first threaded portion and a second threaded portion, wherein the first threaded portion has a first circumference that is greater than a second circumference of the first threaded portion.

11. The apparatus for enclosing contaminants as recited in claim 9, wherein the connector further comprises:

a hollow section, the hollow section configured to enable the protective sleeve to pass through the second end of the handle toward the first end of the handle, and wherein the connector is further configured to secure the flexible cup to the handle.

12. The apparatus for enclosing contaminants as recited in claim 9, wherein the flexible cup further comprises:

an upper base and a lower base, wherein the opening of the lower base is configured to fold inside an internal space of the upper base, and wherein the body of the protective sleeve is secured within the internal space by interior surface of the lower base.

13. The apparatus for enclosing contaminants as recited in claim 9, wherein the shoulder region and the central portion of the protective sleeve form an obtuse angle, the first tail of the protective sleeve and an imaginary line extending from a tip of the first tail to a tip of the second tail, form an acute angle.

14. The apparatus for enclosing contaminants as recited in claim 9, wherein the protective sleeve further comprises:

a centerline passing through an aperture of the tab and passing through a cut-out portion, wherein the first tail and second tail are symmetric about the centerline.

15. The apparatus for enclosing contaminants as recited in claim 9, wherein the apparatus further comprises:

a base portion configured to store the plunger, and wherein the base portion is also configured to enclose the flexible cup and at least a lower portion of the handle.

16. The apparatus for enclosing contaminants as recited in claim 9, comprising:

a valve disposed within the handle.

17. A method of enclosing contaminants utilizing a first protective sleeve with a plunger, the method comprising:

passing the first protective sleeve through an opening in a lower portion of an internal surface of a flexible cup of the plunger, wherein the flexible cup is coupled to a handle, and wherein the first protective sleeve has a leading portion and a trailing portion;

passing the leading portion of the first protective sleeve through a through-hole configured to receive the first protective sleeve, the through-hole is located in the flexible cup offset from an inlet on an exterior surface of the flexible cup, in an external surface of the handle, or in a top portion of the handle;

pulling the trailing portion of the first protective sleeve over an external surface of the flexible cup; and securing a portion of the first protective sleeve to an external surface of the flexible cup or the handle.

18. The method of enclosing contaminants as recited in claim 17, wherein:

the trailing portion is detached from the flexible cup or the handle, wherein the trailing portion is gathered in a manner that closes an opening of the first protective sleeve; and a portion of a second protective sleeve is affixed to the trailing portion of the first protective sleeve.

19. The method of enclosing contaminants as recited in claim 18, wherein:

installing the second protective sleeve by pulling the trailing portion of the first protective sleeve through the through-hole; and detaching the first protective sleeve from the second protective sleeve when a leading portion of the second protective sleeve has passed through the through-hole.

20. The method of enclosing contaminants as recited in claim 17, wherein:

the plunger is secured in a base portion, wherein the base portion is also configured to enclose the flexible cup and at least the lower portion of the handle.

* * * * *